US006819050B1

(12) United States Patent
Zhu et al.

(10) Patent No.: US 6,819,050 B1
(45) Date of Patent: Nov. 16, 2004

(54) METAL HALIDE LAMP WITH TRACE T1I FILLING FOR IMPROVED DIMMING PROPERTIES

(75) Inventors: Huiling Zhu, Lexington, MA (US); Stefaan Maria Lambrechts, Beverly, MA (US); Jakob Maya, Brookline, MA (US)

(73) Assignees: Matsushita Electric Industrial Co., Ltd., Osaka (JP); Matsushita Electric Works, Ltd., Osaka (JP)

( * ) Notice: Subject to any disclaimer, the term of this patent is extended or adjusted under 35 U.S.C. 154(b) by 14 days.

(21) Appl. No.: 10/428,303

(22) Filed: May 2, 2003

(51) Int. Cl.[7] ..... H01J 17/20
(52) U.S. Cl. ..... 313/639; 313/637; 313/640
(58) Field of Search ..... 313/490, 637, 313/638, 639, 640

(56) References Cited

U.S. PATENT DOCUMENTS 3,569,766 A * 3/1971 Larson ..... 313/620
4,808,876 A * 2/1989 French et al. ..... 313/25
5,424,609 A 6/1995 Geven et al.
5,698,948 A 12/1997 Caruso
5,973,453 A 10/1999 Van Vliet et al.
6,031,332 A 2/2000 Wijenberg et al.
6,242,851 B1 6/2001 Zhu et al.

* cited by examiner

*Primary Examiner*—Vip Patel
(74) *Attorney, Agent, or Firm*—Kinney & Lange, P.A.

(57) ABSTRACT

An arc discharge metal halide lamp for use in selected lighting fixtures having a discharge chamber with light permeable ceramic walls about a discharge region. A pair of electrodes are supported in the discharge region spaced apart from one another. Ionizable materials are provided in the discharge region comprising mercury, a noble gas, and at least two metal halides including a magnesium halide and a sodium halide, a rare earth clement, and thallium iodide in a molar quantity which is between 0.7 and 5% of that total molar quantity of all halides present in the discharge chamber.

20 Claims, 4 Drawing Sheets

METAL HALIDE LAMP WITH TRACE T1I FILLING FOR IMPROVED DIMMING PROPERTIES

BACKGROUND OF THE INVENTION

This invention relates to high intensity arc discharge lamps and more particularly to high intensity ceramic metal halide lamps.

Due to the ever-increasing need for energy conserving lighting systems that arc used for interior and exterior lighting, lamps with increasing lamp efficacy are being developed for general lighting applications. Thus, for instance, electrodeless fluorescent lamps have been recently introduced in markets for indoor, outdoor, industrial, and commercial applications. An advantage of such electrodeless lamps is the removal of internal electrodes and heating filaments that are a life-limiting factor of conventional fluorescent lamps. However, electrodeless lamp systems are much more expensive because of the need for a radio frequency power system which leads to a larger and more complex lamp fixture design to accommodate the radio frequency coil with the lamp and electromagnetic interference with other electronic instruments along with difficult starting conditions thereby requiring additional circuitry arrangements.

Another kind of high efficacy lamp is the arc discharge metal halide lamp that is being more and more widely used for interior and exterior lighting. Such lamps arc well known and include a light-transmissive arc discharge chamber sealed about an enclosed a pair of spaced apart electrodes. This chamber typically further contains a chamber materials composition of suitable active materials such as an inert starting gas and one or more ionizable metals or metal halides in specified molar ratios, or both. They can be relatively low power lamps operated in standard alternating current light sockets at the usual 120 Volts rms potential with a ballast circuit, either magnetic or electronic, to provide a starting voltage and current limiting during subsequent operation.

Such lamps may more particularly have a ceramic material arc discharge chamber that usually contains a chamber materials composition having quantities of sodium iodide (NaI), thallium iodide (TlI) and rare earth halides such as dysprosium iodide ($DyI_3$), holmium iodide ($HoI_3$), and thulium iodide ($TmI_3$) along with mercury (Hg) to provide an adequate voltage drop or power loading between the electrodes. Lamps containing those materials have good performance with respect to Correlated Color Temperature (CCT), which lamps typically exhibit relatively lower correlated color temperatures of 2700K to 3700K, and to Color Rendering Index (CRI), and which also have a relatively high efficacy, up to 95 lumens-per-Watt (LPW) when operated at rated power of 150 W. Of course, to further save electric energy in lighting by using more efficient lamps, high intensity arc discharge metal halide lamps with even higher lamp efficacies are needed.

Also, further savings of electrical energy can be had by dimming such lamps during use when full light output is not needed through reducing the electrical current therethrough, and so high intensity arc discharge metal halide lamps with good performance under such dimming conditions are desirable for many lighting applications. However, under these dimming conditions when lamp power is reduced to about 50% of rated value, the performance of currently available lamps of this kind deteriorate significantly. Typically, the correlated color temperature increases significantly, while the color-rendering index (CRI) decreases. Furthermore the efficacy of the lamp usually decreases significantly.

In addition, the lamp hue will deteriorate under such dimming conditions from white to greenish depending on the chemistry. That is, such ceramic material chamber arc discharge metal halide lamps radiate light in which the color rendering index decreases significantly through having a strong green hue due to relatively strong thallium radiation at its characteristic spectral green lines of wavelength 535.0 nm. The discharge tube wall temperatures as well as its cold-spot temperature are much lower at dimming compared to the corresponding temperatures at rated power. At the lower cold-spot temperature occurring under dimming conditions, the ratio of partial pressure of thallium iodide, or TlI, in the discharge tube is much higher compared to the partial pressures of other metal halides leading to this relatively higher TlI partial pressure causing relatively stronger green Tl radiation at the wavelength 535.0 nm. Since the Tl radiation at 535.0 nm is very close to the peak of the human eye sensitivity curve, however, higher lumen efficacy is achieved at rated lamp power with TlI as one of the discharge tube filling components so that it is used in almost all typical commercially available ceramic metal halide lamps.

One possible way of removing the greenish hue under dimming conditions is to remove TlI from the arc discharge chamber altogether and substitute therefor another active material such as $PrI_3$. Another way is to have the arc discharge tube contain halides of Mg, Tl and one or several of the elements from the group formed by scandium (Sc), ytterbium (Y) and lanthanum (Ln). Magnesium iodide, or $MgI_2$, is included as an addition to improve lumen maintenance through influencing the balance of one or several chemical reaction between Sc, Y and Ln and spinel ($MgAl_2O_4$) to such an extent that this balance is achieved shortly after the beginning of the lamp operating life after which further removals of Sc, Y and Ln do not take place. Since the Mg addition through $MgI_2$ is for reducing chemical reaction between the chamber materials composition components and the chamber wall, the quantity of $MgI_2$ used in chamber materials composition components in this arrangement is based on the surface area of the inner wall of the discharge vessel.

The arc discharge tube in this last described arrangement is operated within an evacuated outer envelope to reduce convection heat loss from the cold spot of the discharge chamber, and with a metal beat shield used on the discharge chamber to reduce radiation heat loss from the cold-spot during dimming because of the thermal emissivity of the metal shield being much lower than that of the arc discharge chamber ceramic surface, and because of the emissivity of the metal going down as the temperature drops thereby keeping the chamber cold spot temperature and the vapor pressure of the salts in the chamber substantially constant. However, such a lamp still has the disadvantage of radiating with a relatively strong green hue when dimmed to lower than the rated power due to the relatively higher vapor pressure of TlI under dimming conditions, and the further disadvantage that the widely used high voltage starting pulses on low wattage metal halide lamps, when used in conjunction with a vacuum envelope, may make the lamp susceptible to arcing if the discharge tube leaks or slow outer jacket leaks exist. Thus, there is a desire for arc discharge metal halide lamps having higher efficacies and better color performance under dimming conditions.

BRIEF SUMMARY OF THE INVENTION

The present invention provides an arc discharge metal halide lamp for use in selected lighting fixtures having a discharge chamber with electromagnetic radiation or visible light permeable walls of a selected shape bounding a discharge region through which walls a pair of electrodes are supported in the discharge region spaced apart from one another. Ionizable materials are provided in the discharge region of the discharge chamber comprising mercury, a noble gas, and at least two metal halides including a magnesium halide and a sodium halide, a rare earth element, and thallium iodide in a molar quantity which is between 0.7 and 5% of that total molar quantity of all halides present in the discharge chamber.

The discharge chamber can have walls formed of polycrystalline alumina among other materials, and is enclosed in a visible light permeable bulbous envelope positioned in a base with electrical interconnections extending from the discharge chamber to the base and contains a nitrogen gas atmosphere. A shroud of a visible light permeable material can be provided about the discharge chamber. The ionizable materials can further include halides of a series of rare earth elements comprising dysprosium, holmium, thulium, cerium, praseodymium, scandium, neodymium, europium, lutetium and lanthanum so that the total molar quantity of such halides along with the metal halides present in said discharge chamber is between 95 and 99.3% of that total molar quantity of all halides present in said discharge chamber.

DETAILED DESCRIPTION

Figure 1:
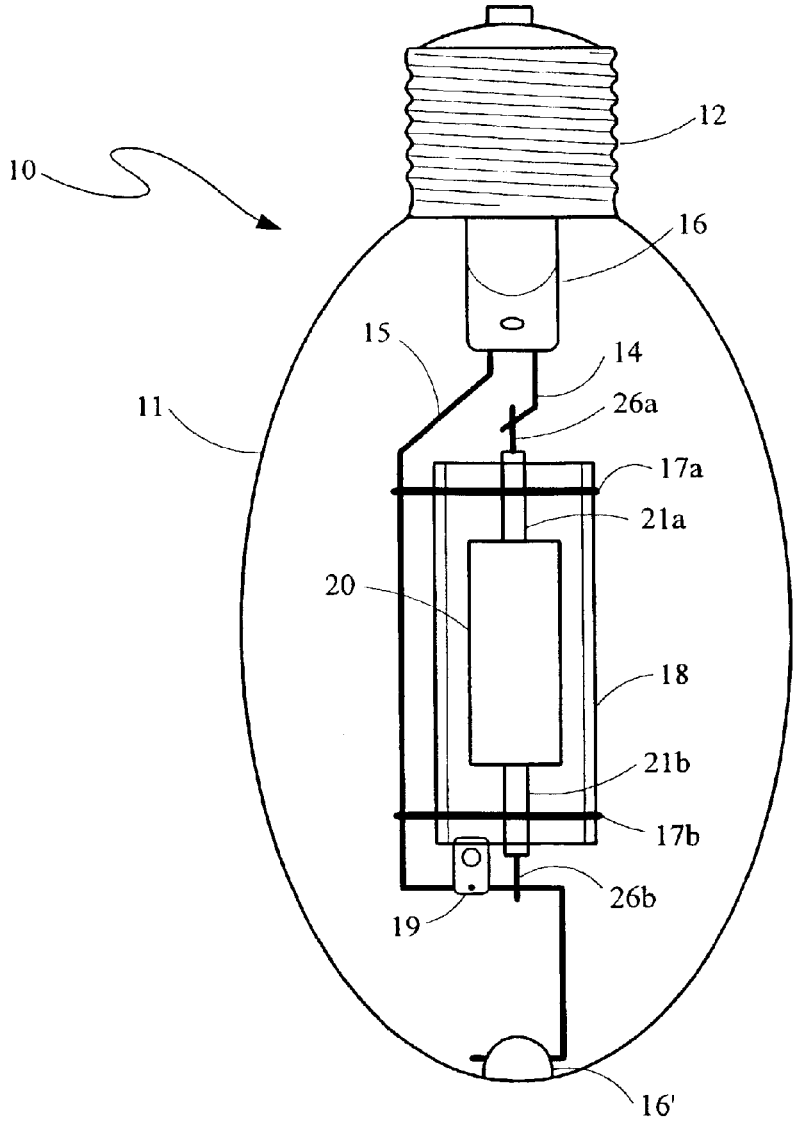
FIG. 1 is a side view, partially in cross section, of an arc discharge metal halide lamp of the present invention having a ceramic arc discharge chamber of a selected configuration therein.

Referring to FIG. 1, an arc discharge metal halide lamp, 10, is shown in a partial cross section view having a bulbous, transparent borosilicate glass envelope, 11, partially cut away in this view, fitted into a conventional Edison-type metal base, 12. Lead-in, or electrical access, electrode wires, 14 and 15, of nickel or soft steel, each extend from a corresponding one of the two electrically isolated electrode metal portions in base 12 parallely through and past a borosilicate glass flare, 16, positioned at the location of base 12 and extending into the interior of envelope 11 along the axis of the major length extent of that envelope. Electrical access wires 14 and 15 extend initially on either side of, and in a direction parallel to, the envelope length axis past flare 16 to have portions thereof located further into the interior of envelope 11 with access wire 15 extending after some bending into a borosilicate glass dimple, 16', at the opposite end of envelope 11. Electrical access wire 14 is provided with a second section in the interior of envelope 11 extending at an angle to the first section that parallels the envelope length axis by having this second section welded at such an angle to the first section so that it ends after more or less crossing the envelope length axis.

Some remaining portion of access wire 15 in the interior of envelope 11 is bent at acute angle away from the initial direction thereof parallel to the envelope length axis. Access wire 15 with this first bend therein past flare 16 directing it away from the envelope length axis, is bent again to have the next portion thereof extend substantially parallel that axis, and further along bent again at a right angle to have the succeeding portion thereof extend substantially perpendicular to, and more or less cross that axis near the other end of envelope 11 opposite that end thereof fitted into base 12. The portion of wire 15 extending parallel to the envelope length axis has welded thereto a pair of spaced apart support straps, 17A and 17B, of the same material as wire 15 which in turn support a shroud, 18, formed as an optically transparent, truncated cylindrical shell of quartz to limit gaseous flows in the interior thereof so as to maintain relatively constant temperatures therein. The succeeding portion of wire 15 perpendicular to the envelope length axis supports a conventional getter, 19, to capture gaseous impurities. Two additional right angle bends are provided further along in wire 15 to thereby place a short remaining end portion of that wire below and parallel to the portion thereof originally described as crossing the envelope length axis which short end portion is finally anchored at this far end of envelope 11 from base 12 in glass dimple 16'.

A ceramic arc discharge chamber, 20, configured about a contained region as a shell structure having polycrystalline alumina walls that are translucent to visible light, is shown in one of various possible geometric configurations in FIG. 1 positioned within shroud 18. Alternatively, the walls of arc discharge chamber 20 could be formed of aluminum nitrite, yttria ($Y_2O_3$), sapphire ($Al_2O_3$), or some combinations thereof. Both shroud 18 and discharge chamber 20 are provided within envelope 11 in a nitrogen gas atmosphere at a relatively high pressure greater than 300 mmHg, typically between about 360 and 600 mmHg, which makes the lamp much less susceptible to catastrophic failure compared to a vacuum in envelope 11 that risks the occurrence of arcing should a slow leak develop in arc chamber 20 or envelope 11. Thus this shroud can not only stabilize the temperature about chamber 20, as indicated above, but can also provide containment of resulting debris, etc. from any explosive structural failure of that chamber to thereby protect envelope 11 from any resulting impulsive stresses that may otherwise lead to the breaking apart thereof.

The region enclosed in arc discharge chamber 20 contains various ionizable materials, including metal halides and mercury which emit light during lamp operation and a starting gas such as the noble gases argon (Ar) or xenon (Xe). In this structure for arc discharge chamber 20 as better seen in the cross section view thereof in FIG. 2, a pair of polycrystalline alumina, relatively small inner and outer diameter truncated cylindrical shell portions, or capillary tubes, 21*a* and 21*b*, are each concentrically joined to a corresponding one of a pair of polycrystalline alumina end closing disks, 22*a* and 22*b*, about a centered hole therethrough so that an open passageway extends through each capillary tube and through the hole in the disk to which it is joined. These end closing disks are each joined to a corresponding end of a polycrystalline alumina tube, 25, formed as a relatively large diameter truncated cylindrical shell, to be about the enclosed region to provide the primary arc discharge chamber. These various portions of arc discharge tube 20 are formed by compacting alumina powder into the desired shape followed by sintering the resulting compact to thereby provide the preformed portions, and the various preformed portions are joined together by sintering to result in a preformed single body of the desired dimensions having walls impervious to the flow of gases.

Chamber electrode interconnection wires, 26*a* and 26*b,* of niobium each extend out of a corresponding one of tubes 21*a* and 21*b* to reach and be attached by welding to, respectively, access wire 14 at its end portion crossing the envelope length axis and to access wire 15 at its portion first described as crossing the envelope length axis. This arrangement results in chamber 20 being positioned and supported between these portions of access wires 14 and 15 so that its long dimension axis approximately coincides with the envelope length axis, and further allows electrical power to be provided through access wires 14 and 15 to chamber 20.

Figure 2:
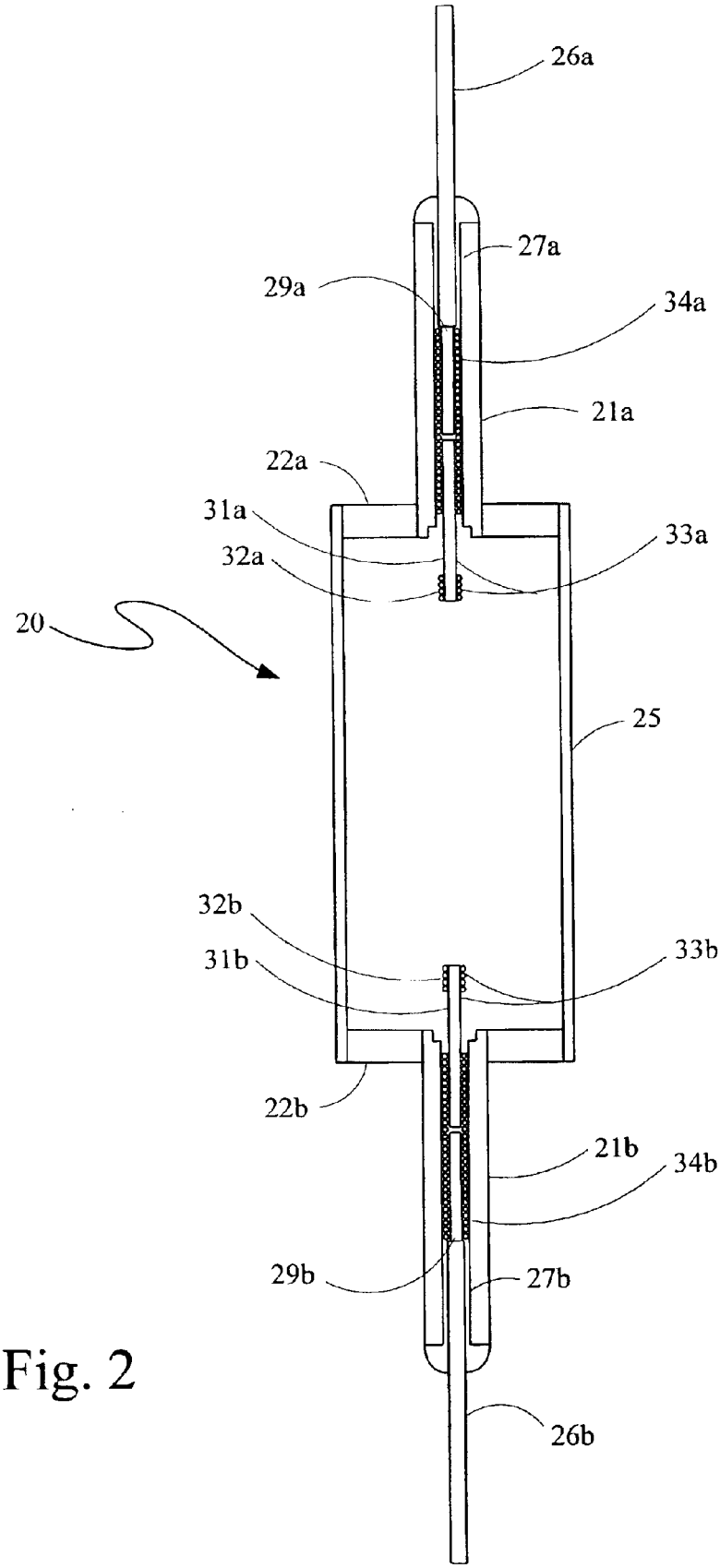
FIG. 2 shows the arc discharge chamber of FIG. 1 in cross section in an expanded view.

FIG. 2 shows the discharge region contained within the bounding walls of arc discharge chamber 20 that are provided by structure 25, disks 22*a* and 22*b,* and tubes 21*a* and 21*b* of FIG. 1. Chamber electrode interconnection wire 26*a,* being of niobium, has a thermal expansion characteristic that relatively closely matches that of tube 21*a* and that of a glass frit, 27*a,* affixing wire 26*a* to the inner surface of tube 21*a* (and hermetically sealing that interconnection wire opening with wire 26*a* passing therethrough) but cannot withstand the resulting chemical attack resulting from the forming of a plasma in the main volume of chamber 20 during operation. Thus, a molybdenum lead-through wire, 29*a,* which can withstand operation in the plasma, is connected to one end of interconnection wire 26*a* by welding, and other end of lead-through-wire 29*a* is connected to one end of a tungsten main electrode shaft, 31*a,* by welding.

In addition, a tungsten electrode coil, 32*a,* is integrated and mounted to the tip portion of the other end of the first main electrode shaft 31*a* by welding, so that an electrode, 33*a,* is configured by main electrode shaft 31*a* and electrode coil 32*a*. Electrode 33*a* is formed of tungsten for good thermionic emission of electrons while withstanding relatively well the chemical attack of the metal halide plasma. Lead-through wire 29*a,* spaced from tube 21*a* by a molybdenum coil, 34*a,* serves to dispose electrode 33*a* at a predetermined position in the region contained in the main volume of arc discharge chamber 20. A typical diameter of interconnection wire 26*a* is 0.9 mm, and a typical diameter of electrode shaft 31*a* is 0.5 mm.

Similarly, in FIG. 2, chamber electrode interconnection wire 26*b* is affixed by a glass frit, 27*b,* to the inner surface of tube 21*b* (and hermetically sealing that interconnection wire opening with wire 26*b* passing therethrough). A molybdenum lead-through wire, 29*b,* is connected to one end of interconnection wire 26*b* by welding, and other end of lead-through-wire 29*b* is connected to one end of a tungsten main electrode shaft, 31*b,* by welding. A tungsten electrode coil, 32*b,* is integrated and mounted to the tip portion of the other end of the first main electrode shaft 31*b* by welding, so that an electrode, 33*b,* is configured by main electrode shaft 31*b* and electrode coil 32*b*. Lead-through wire 29*b,* spaced from tube 21*b* by a molybdenum coil, 34*b,* serves to dispose electrode 33*b* at a predetermined position in the region contained in the main volume of arc discharge chamber 20. A typical diameter of interconnection wire 26*b* is also 0.9 mm, and a typical diameter of electrode shaft 31 is again 0.5 mm.

The lamp of FIGS. 1 and 2 achieves superior lamp performance under dimming conditions with ceramic discharge vessel 20, positioned in nitrogen filled envelope 11, having therein a provision of magnesium iodide, or $MgI_2$, to replace the major part of the TlI chamber materials composition component used in the chamber materials compositions of typical ceramic chamber metal halide lamps. $MgI_2$ is used to replace the major part of TlI as one of the chamber materials composition components because Mg exhibits green radiation for higher efficacy and has a similar vapor pressure variation with temperature as that of the rare earth iodides also present in the discharge chamber materials composition. A small amount of TlI as a chamber materials composition component is added to the chamber composition for metal halide lamps with relatively lower correlated color temperatures (2700K to 3700K) to assure that the light emitted under dimming conditions is still close to that emitted by a black body. Since ceramic metal halide lamps with relatively lower correlated color temperatures have relatively higher NaI content, lamps without TlI will emit light with lower correlated color temperature under dimming conditions compared to that at rated wattage. They will also have a pinkish hue due to the relatively higher NaI content in the lamp chamber materials composition for the lower color temperatures. A small amount of TlI in the chamber materials composition will help to raise the—y coordinate of the chromaticity under dimming conditions so the light emitted will be close to that emitted by a black body even under such conditions. Since only a small amount of TlI is added in the lamp chamber materials composition, there is no green hue in the light emitted from such lamps being operated at rated lamp power.

On the other hand, due to metal halide vapor pressure variation with temperature variation that is similar to that of rare-earth halides, the partial pressure of the $MgI_2$ component replacing most of the TlI component will drop under dimming conditions proportionally to that of the other rare-earth halides used as components in the lamp chamber materials composition. This performance leads to a white light output from the lamp even under dimming conditions rather than the greenish hue of the lamps with a relatively large TlI dose in typical commercially available ceramic chamber metal halide lamps.

In addition, the relatively higher vapor pressure of $MgI_2$ at rated lamp power results in relatively strong green radiation at the wavelength of 518.4 nm in these conditions. Since the Mg radiation at the wavelength of 518.4 nm is very close to the peak of the human eye sensitivity curve, higher lumen efficacy is achieved at rated lamp power with $MgI_2$ as one of the lamp chamber materials composition components. The quantity of the $MgI_2$ used as a component in the chamber materials composition is chosen for light emission reasons and for better lamp performance under dimming conditions so that the optimum quantity is based on the lamp performance under rated lamp power and reduced lamp power conditions and not the surface area of the discharge vessel.

In one realization of the lamp of FIGS. 1 and 2 having a rated power of 150W, the chamber materials composition in arc discharge chamber 20 includes 12 mg Hg and 10.6 mg total of the metal halides $HoI_3$, $TmI_3$, $MgI_2$, NaI and TlI in respective molar ratios of 1:3.2:8.7:24.1:0.5. In addition, the composition comprises Ar with a filling pressure of 160 mbar as an ignition gas. Generally, in any realization of the lamp of FIGS. 1 and 2, TlI should be present in arc discharge chamber 20 in a molar quantity which is between 0.7 and 5% of the total molar quantity of the total halides present in the chamber. Halides of one or more of the rare earth elements of the series dysprosium (Dy), holmium (Ho), thulium (Tm), Cerium (Ce), praseodymium (Pr), scandium (Sc), neodymium (Nd), europium (Eu), lutetium (Lu) and lanthanum (La) can be alternatively or jointly used such that the total molar quantity of halides of Na and Mg, and of the rare earth elements, present in arc discharge chamber 20 is between 95 and 99.3%. In one example, a halide of dysprosium can be used in discharge chamber 20 having a molar quantity that is between 0 to 20% of that total molar quantity of all halides present therein.

In the following Table 1 for a pair of lamps of one correlated color temperature and Table 2 for a pair of lamps of another correlated color temperature, characteristics are presented in tabular form of FIGS. 1 and 2 ceramic arc discharge chamber metal halide lamps, as just described, with a small amount of TlI in the chamber materials compositions, and of corresponding typical commercially available lamps with typically used doses of TlI in the chamber materials compositions thereof. The data are listed for these lamps operated both at the rated lamp power of 150W and at 50% of rated lamp power in a dimmed condition:

TABLE 1

| 3500 K | Mg, Na, and rare earth halides + 1.3 mole % T1I | | Na, rare earth halides + typical amount of T1I (9.1 mole %) | |
|---|---|---|---|---|
| Lamps | 150 W | 75 W | 150 W | 75 W |
| LPW | 91 | 72 | 85 | 68 |
| CCT | 3513 | 3574 | 3552 | 4484 |
| CRI | 90 | 71 | 92 | 70 |
| Duv | −0.8 | −1.7 | 3.3 | 17.2 |

Lamp characteristics of a 3500K correlated color temperature lamp with a very low TlI dose and a 3500K correlated color temperature lamp with a typical TlI dose.

TABLE 2

| 3000 K | Mg, Na, and rare earth halides + 0.5 mole % T1I | | Na, rare earth halides + typical amount of T1I (9.8 mole %) | |
|---|---|---|---|---|
| Lamps | 150 W | 75 W | 150 W | 75 W |
| LPW | 86.4 | 69.0 | 87.4 | 68.8 |
| CCT | 3039 | 3013 | 3072 | 4075 |
| CRI | 87 | 63 | 83 | 62 |
| Duv | −5.1 | −6.6 | −2.8 | 25.3 |

Lamp characteristics of a 3000K correlated color temperature lamp with a very low TlI dose and a 3000K correlated color temperature lamp with a typical TlI dose. Duv is a parameter to represent a comparison of light emitted from a lamp to the light emitted from a black body radiator. The greater the value of the Duv parameter the larger the deviation of the light emitted by a lamp from the light correspondingly emitted by a black body with respect to whiteness of that light. Note in Table 1 that a small amount of TlI in combination with $MgI_2$ results in a lamp that is vastly superior in dimming performance to a lamp with a large amount of TlI and without $MgI_2$ For example, the Duv and CCT change in going from 150W to 75W with a low TlI dose in the lamp chamber is only 0.9 units and 61K, respectively, while, in a typical commercially available lamp of the kind offered under the brand name PANASONIC, the changes in Duv and CCT are 13.9 units and 932K, respectively. The changes of Duv and CCT in the lamp of FIGS. 1 and 2 are not distinguishable to the naked eye, while the changes of Duv and CCT in typical commercially available lamps are very distinguishable and very annoying to the naked eye. The same conclusions can be drawn from the data in Table 2.

FIGS. 3 to 6 show comparisons of results of lamps corresponding to FIGS. 1 and 2 with a typical commercially available ceramic chamber metal halide lamp. The lamps were operated with a reference ballast and measured in a two meter integrating sphere under accepted conditions promulgated by the Illuminating Engineering Society of North America. The data was acquired with a charge coupled device-based computerized data acquisition system. All data presented in FIGS. 3 to 6 were obtained with the operating position of the lamp being vertical base up. The experiments, for which the data is presented in FIGS. 3 to 6 were conducted using 150W ceramic metal halide arc discharge chamber.

During operation of the lamps according to the present invention, and when comparing them to typical commercially available lamps, the latter lamps turned greenish on dimming and deviated substantially from the black body emission performance upon dimming to about 50% of rated power. In contrast, when the lamps of FIGS. 1 and 2 realized with the chamber materials composition described above were dimmed to about 50%, they still emitted substantially as a black body, had no greenish hue, and generally looked white. Such color was satisfactory to the eye and it was substantially impossible to discern any color or hue change under dimmed conditions.

Figure 3:
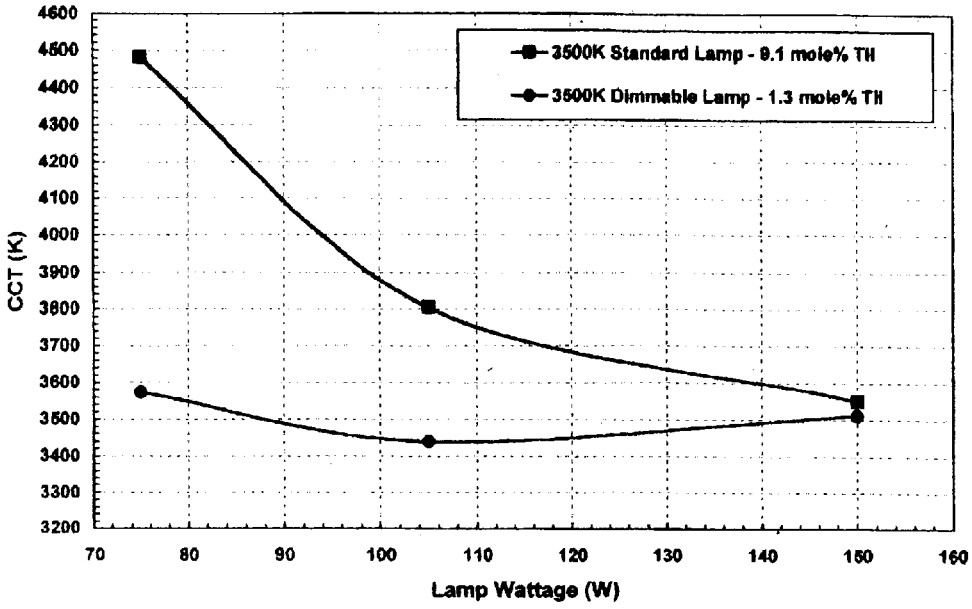
FIG. 3 shows a graph of the changes in the Correlated Color Temperature (CCT) with changes in lamp power dissipation for a 100-hour photometry measurement of the lamp of FIG. 1 and a typical prior art lamp.

FIG. 3 shows in graphical form the changes of correlated color temperature (CCT) when these lamps are dimmed from operation at rated power. The CCT of the FIGS. 1 and 2 lamp realized as above did not have any significant change when the lamp was dimmed to 50% of its rated power. The typical commercial lamp, however, had a CCT change that was significant when that lamp was dimmed to 50% of its rated power.

Figure 4:
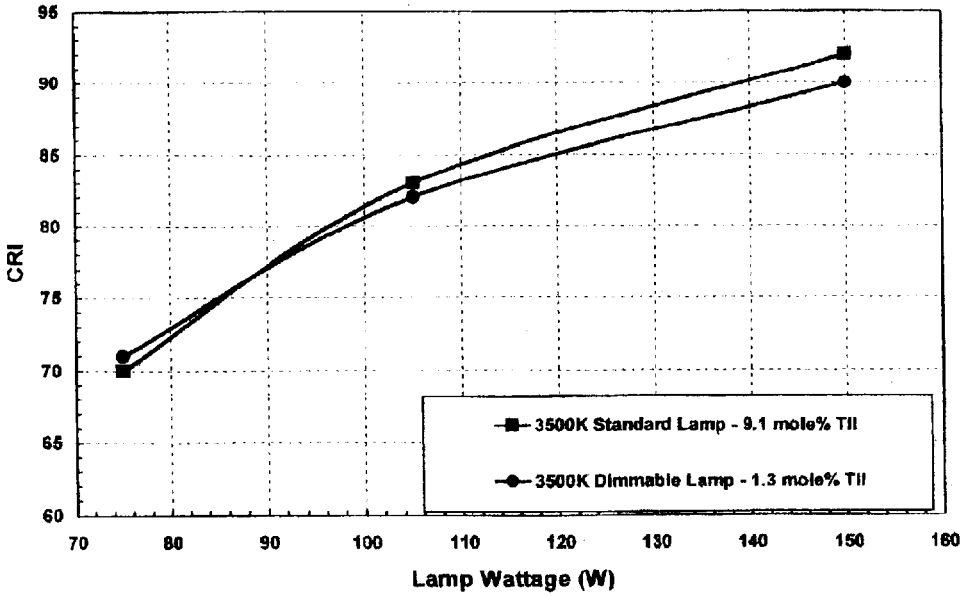
FIG. 4 shows a graph of the changes in the Color Rendering Index (CRI) with changes in lamp power dissipation for a 100-hour photometry measurement of the lamp of FIG. 1 and a typical prior art lamp.

FIG. 4 shows in graphical form the changes of in the color rendering index (CRI) when these lamps are dimmed from operation at rated power. The CRI of the FIGS. 1 and 2 lamp realized as above changed less than the CRI of the typical commercial lamp when these lamps were dimmed to 50% of rated power.

Figure 5:
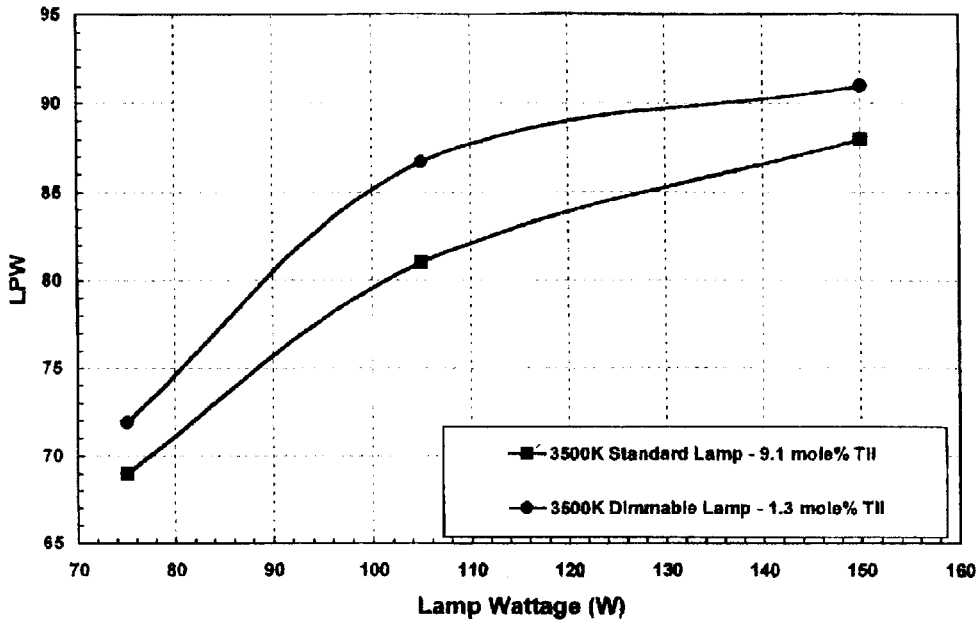
FIG. 5 shows a graph of the changes in the lamp efficacy in lumens per watt (LPW) with changes in lamp power dissipation for a 100-hour photometry measurement of the lamp of FIG. 1 and a typical prior art lamp.

FIG. 5 shows in graphical form the changes in lamp efficacy in lumens per watt (LPW) when these lamps are dimmed from operation at rated power. The LPW of the FIGS. 1 and 2 lamp realized as above and of the typical commercial lamp change in a very similar fashion when dimmed to 50% of rated power.

Figure 6:
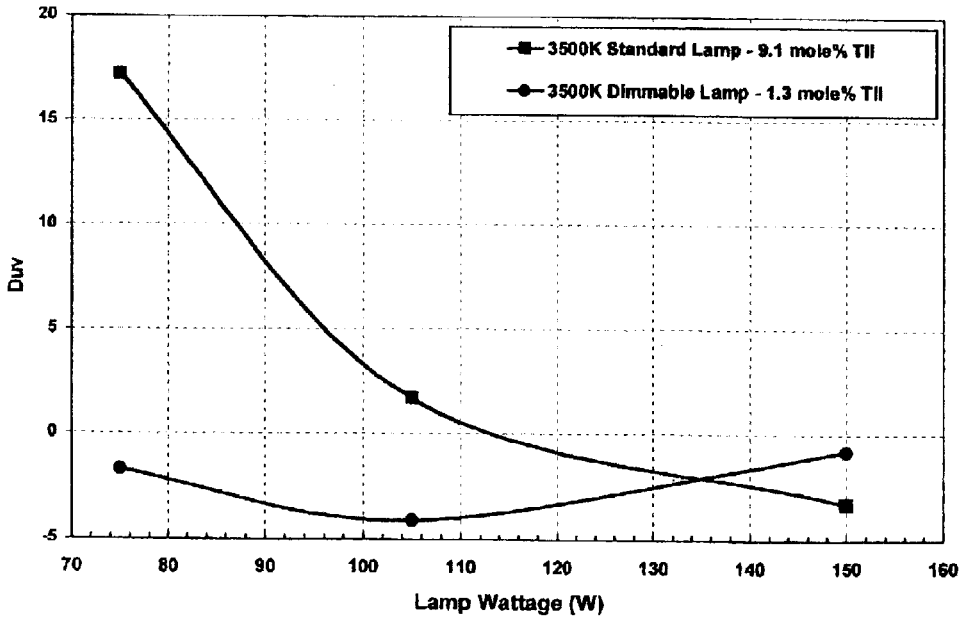
FIG. 6 shows a graph of the changes in the deviation of lamp radiation from the radiation of a blackbody radiator with changes in lamp power dissipation for a 100-hour photometry measurement of the lamp of FIG. 1 and a typical prior art lamp.

FIG. 6 shows in graphical form the changes of lamp Duv when these lamps are dimmed from operation at rated power. The Duv of the FIGS. 1 and 2 lamp realized as above did not have significant change when that lamp was dimmed to 50% of its rated power. The typical commercial lamp, however, had a Duv change that was significant when that lamp was dimmed to 50% of its rated power.

Therefore, FIGS. 1 and 2 lamps realized as above, containing $MgI_2$ and very low molar ratio of TlI, are shown to perform comparably to typical commercial lamps at rated lamp power. The indict of such performance relied upon includes efficacy, CCT, CRI and Duv. However, when typical commercial lamps are dimmed to 50% of their rated power their resulting performance measured by the same indict deteriorates substantially. Most significant in this deterioration, from the end user's point of view, are the changes in CCT and hue with the latter being indicated by the changes in the Duv. These unwanted changes during dimmings are eliminated by the substitution for major portion of TlI chamber materials composition component in typical commercially available ceramic chamber metal halide lamps by $MgI_2$ to thereby leave only a very small relative amount of TlI in the lamp arc discharge chambers of the FIGS. 1 and 2 lamps so that they substantially retain the same CCT and hue throughout the dimming range, that is, remaining white throughout the dimming range.

Although the present invention has been described with reference to preferred embodiments, workers skilled in the art will recognize that changes may be made in form and detail without departing from the spirit and scope of the invention.

What is claimed is:

1. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another; and ionizable materials provided in said discharge region of said discharge chamber comprising mercury, a noble gas, and at least two metal halides including a magnesium halide and a sodium halide, a rare earth element, and thallium iodide in a molar quantity which is between 0.7 and 5% of that total molar quantity of all halides present in said discharge chamber.

2. The device of claim 1 wherein said discharge chamber is formed of walls comprising one or more of polycrystalline alumina, aluminum nitrite, yttria and sapphire.

3. The device of claim 1 further comprising a bulbous envelope having an visible light permeable wall enclosing said discharge chamber and being positioned in a base with electrical interconnections extending from said discharge chamber to said base.

4. The device of claim 1 wherein said rare earth elements are one or more of a series of rare earth elements comprising dysprosium, holmium, thulium, cerium, praseodymium, scandium, neodymium, europium, lutetium and lanthanum.

5. The device of claim 1 wherein that total molar quantity of halides of sodium and magnesium, and of said rare earth elements, present in said discharge chamber is between 95 and 99.3% of that total molar quantity of all halides present in said discharge chamber.

6. The device of claim 2 wherein said discharge chamber is formed of walls of polycrystalline alumina.

7. The device of claim 3 further comprising a shroud having a visible light permeable wall and being positioned about said discharge chamber within said envelope.

8. The device of claim 3 further comprising said envelope enclosing a nitrogen gas atmosphere at a pressure exceeding 300 mmHg.

9. The device of claim 4 wherein a halide of dysprosium is present in said discharge chamber having a molar quantity that is between 0 to 20% of that total molar quantity of all halides present in said discharge chamber.

10. An arc discharge metal halide lamp for use in selected lighting fixtures, said lamp comprising:

a discharge chamber having visible light permeable walls of a selected shape bounding a discharge region formed of polycrystalline alumina through which walls a pair of electrodes are supported in said discharge region spaced apart from one another; and ionizable materials provided in said discharge region of said discharge chamber comprising mercury, a noble gas, halides of magnesium, sodium and indium, one or more halides of dysprosium, holmium, thulium, cerium, praseodymium, scandium, neodymium, europium, lutetium and lanthanum, and thallium iodide in a molar quantity which is between 0.7 and 5% of that total molar quantity of all halides present in said discharge chamber.

11. The device of claim 10 wherein said thallium iodide is present in said discharge chamber in a molar quantity which is between 0.7 and 4% of that total molar quantity of all halides present in said discharge chamber.

12. The device of claim 10 wherein said thallium iodide is present in said discharge chamber in a molar quantity which is between 0.7 and 2% of that total molar quantity of all halides present in said discharge chamber.

13. The device of claim 10 further comprising a bulbous envelope having a visible light permeable wall enclosing said discharge chamber and being positioned in a base with electrical interconnections extending from said discharge chamber to said base.

14. The device of claim 13 further comprising a shroud having a visible light permeable wall and being positioned about said discharge chamber within said envelope.

15. The device of claim 13 further comprising said envelope enclosing a nitrogen gas atmosphere at a pressure exceeding 300 mmHg.

16. An arc discharge metal halide lamp for use in selected lighting fixtures, said lamp comprising:

a discharge chamber having visible light permeable walls of a selected shape bounding a discharge region formed of polycrystalline alumina through which walls a pair of electrodes are supported in said discharge region spaced apart from one another; and ionizable materials provided in said discharge region of said discharge chamber comprising halides of dysprosium, holmium, thulium, sodium and magnesium, and thallium iodide in a molar quantity which is less than 5% of that total molar quantity of all halides present in said discharge chamber.

17. The device of claim 16 wherein that total molar quantity of halides of dysprosium, holmium, thulium, sodium and magnesium present in said discharge chamber is between 95 and 99.3% of that total molar quantity of all halides present in said discharge chamber.

18. The device of claim 16 further comprising a bulbous envelope having a visible light permeable wall enclosing said discharge chamber and being positioned in a base with electrical interconnections extending from said discharge chamber to said base.

19. The device of claim 18 further comprising a shroud having a visible light permeable wall and being positioned about said discharge chamber within said envelope.

20. The device of claim 18 further comprising said envelope enclosing a nitrogen gas atmosphere at a pressure exceeding 300 mmHg.

* * * * *